US005942976A

United States Patent [19]

Wieser et al.

[11] Patent Number: 5,942,976

[45] Date of Patent: Aug. 24, 1999

[54] PASSIVE INFRARED INTRUSION DETECTOR AND ITS USE

[75] Inventors: Dieter Wieser, Zürich; Kurt Albert Müller, Männedorf; Martin Allemann, Wetzikon; Michael Thomas Gale, Wettswil a. Albis; Thomas Hessler, Zürich, all of Switzerland

[73] Assignee: Cerberus AG, Switzerland

[21] Appl. No.: 08/742,813

[22] Filed: Nov. 1, 1996

[30] Foreign Application Priority Data

Nov. 3, 1995 [EP] European Pat. Off. ..... 95117323

[51] Int. Cl.[6] ..... G08B 13/00

[52] U.S. Cl. ..... 340/565; 340/567; 250/DIG. 1

[58] Field of Search ..... 340/565, 567; 250/342, 353, DIG. 1

[56] References Cited

U.S. PATENT DOCUMENTS

| | | | |
|---|---|---|---|
| 4,242,669 | 12/1980 | Crick | 340/557 |
| 4,375,034 | 2/1983 | Guscott | 340/567 |
| 4,710,629 | 12/1987 | Müller et al. | 250/DIG. 1 |
| 4,752,768 | 6/1988 | Steers et al. | 340/567 |
| 5,424,718 | 6/1995 | Müller et al. | 340/567 |
| 5,489,892 | 2/1996 | Imuro et al. | 340/567 |
| 5,491,467 | 2/1996 | Tracy et al. | 340/567 |
| 5,499,016 | 3/1996 | Pantus | 340/567 |

FOREIGN PATENT DOCUMENTS

| | | |
|---|---|---|
| 0189536 | 8/1986 | European Pat. Off. . |
| 0358929 | 3/1990 | European Pat. Off. . |
| 0481934 | 4/1992 | European Pat. Off. . |
| 0499177 | 8/1992 | European Pat. Off. . |
| 0507025 | 10/1992 | European Pat. Off. . |
| 0660284 | 6/1995 | European Pat. Off. . |
| 2520123 | 7/1983 | France . |
| 8300558 | 2/1983 | WIPO . |

*Primary Examiner*—Jeffery A. Hofsass
*Assistant Examiner*—John Tweel, Jr.
*Attorney, Agent, or Firm*—Baker & Botts, L.L.P.

[57] ABSTRACT

A passive infrared intrusion detector for the detection of infrared body radiation includes a sabotage detector, in particular for detecting spraying of the entrance window of the intrusion detector. The sabotage detector includes a light source, a corresponding light sensor, and an optical diffraction grating structure on the outside of the entrance window. The light source and the light sensor can be on the same or on opposite sides of the entrance window. By first- or higher-order diffraction, light from the light source is focused onto the sensor, and a resulting electrical signal from the sensor is evaluated by an evaluation circuit. In case of sabotage, the focusing effect of the optical diffraction grating structure vanishes, so that the light intensity at the detector is reduced. The drop in light intensity triggers a sabotage alarm signal.

10 Claims, 4 Drawing Sheets

PASSIVE INFRARED INTRUSION DETECTOR AND ITS USE

TECHNICAL FIELD

The invention concerns a passive infrared intrusion detector which, more particularly, includes a sabotage detector.

BACKGROUND OF THE INVENTION

Passive infrared intrusion detectors are being used for monitoring spaces, e.g. in museums, banks and industrial areas. Such detectors detect infrared body radiation from intruders, in a wavelength range from approximately 6 to 15 μm. They consist essentially of a housing with an entrance window which is transparent to the infrared radiation, focusing optics, one or more infrared sensors, and an electrical signal evaluation and alarm activating circuit. The entrance window typically consists of infrared-transparent polypropylene or polyethylene. If an intruder enters the area monitored by the detector, his infrared body radiation enters through the entrance window into the intrusion detector and is focused by the focusing optics onto the infrared sensors. The infrared sensors output a signal to the evaluation circuit which amplifies the signal and compares it to a predetermined threshold. If the threshold is exceeded, an intrusion alarm signal is generated.

Increasingly in recent times, passive infrared intrusion detectors are being tampered with and rendered inoperative by unauthorized persons. Typically, for example, an infrared detector is sabotaged so that infrared radiation cannot pass through its entrance window, rendering it blind to radiation of interest, preventing the detection of intruders, and allowing them freely to move about the area without being noticed. Typically, sabotage takes place when the intrusion detector is insensitive, i.e. at a time when it is in a stand-by mode when people are allowed to be present in the space. A known method of sabotage involves covering the intrusion detector with an object such as a piece of cardboard or a screen. This type of sabotage can be readily noticed and remedied by security guards, however. A more sophisticated type of sabotage which is not readily noticeable to security guards involves spraying the entrance window with a spray such as an adhesive or hair spray, for example. These sprays are visually transparent, but are opaque to radiation in the infrared range. They are easy to obtain, and can be sprayed onto the entrance window very quickly. This method of sabotage currently is the most prevalent. For autonomous, automatic detection of such sabotage, recent-model detectors are equipped with a means for detecting sabotage, in particular for monitoring the entrance window. Detection may be immediate, at the time of the sabotage in the insensitive state, or only in the sensitive state of the detector.

An intrusion detector of this type is disclosed in European Patent Document EP-0499177, for example. For sabotage detection, this detector has an active radiation source on one side of the entrance window, whose radiation is transmitted through the entrance window and received by a sensor on the other side of the window. The electrical signal output by the sensor is evaluated by a circuit. The radiation is used to measure the optical transmittance of the entrance window and to monitor the space immediately in front of the entrance window for the presence of objects. The characteristics of this radiation are chosen so as not to interfere with the normal operation of the intrusion detector, i.e., the detection of infrared body radiation. If the intrusion detector is sabotaged by covering or spraying, the amount of radiation received by the sensor is increased or decreased. If the sensor signal is outside a predetermined range, a sabotage alarm signal is generated. The radiation source typically is an LED which radiates in the near-infrared region. As a spray used for sabotage is partially transparent in this region, the change in signal strength due to sabotage is small, and the sabotage alarm signal is unreliable. A similar intrusion detector is disclosed in European Patent Document EP-0189536, where a resistor is used as a radiation source which simulates thermal body radiation. Power consumption of the resistor is quite high.

SUMMARY OF THE INVENTION

It is an object of the present invention to provide a passive infrared intrusion detector with a sabotage detection capability for positively detecting and signalling an act of sabotage, e.g., the spraying of the entrance window with a spray which is opaque to infrared radiation.

A preferred passive infrared intrusion detector includes a source of radiation in the near-infrared region, a corresponding sensor, and an optical diffraction grating structure on the outside of the entrance window which focuses radiation from the source onto the sensor. In a preferred first embodiment, the source and the sensor lie on different sides of the entrance window. In a preferred second embodiment, both the source and the sensor are located behind the entrance window. The sabotage detector monitors the entrance window for changes, e.g., due to spraying by sprays or other contaminants. The radiation from the source is directed onto the entrance window to monitor the condition of the surface of the entrance window, as the diffraction grating structure on the entrance window focuses a portion of the radiation onto the sensor by first- or higher-order diffraction. Where both the source and the sensor are disposed on the same side of the entrance window, diffraction involves reflection; where they are on opposite sides, transmission is involved. When the focused radiation is received, the sensor outputs an electrical signal to an evaluation circuit, indicating the state of the entrance window. In the normal state the entrance window is intact and the grating structure focuses a portion of the radiation onto the sensor. In the event of sabotage by spraying the entrance window, e.g., with an adhesive spray, the grating structure is coated with the adhesive and thereby modified by being filled in, and the surface of the entrance window becomes that of a diffuser. This impedes the focusing effect of the optical diffraction grating structure, and the radiation received by the sensor is reduced significantly. If the signal output from the sensor to the evaluation circuit falls below a predetermined threshold, the evaluation circuit generates a sabotage alarm signal.

Advantageously, the focusing diffraction grating on the entrance window amplifies the monitoring signal, so that the signal change in case of sabotage is also large, for positive sabotage detection.

Arranging radiation source and sensor behind the entrance window is advantageous additionally in that assembly is facilitated. The two elements are preferably integrated on the same printed circuit board as the evaluation-for-intrusion circuit of the intrusion detector. This permits simple and cost-effective assembly, e.g., the use of elements such as surface mount devices (SMD) or of integrated elements including the radiation source, the sensor and associated electrical driver or amplifier circuits.

DETAILED DESCRIPTION OF PREFERRED EMBODIMENTS

Figure 1:
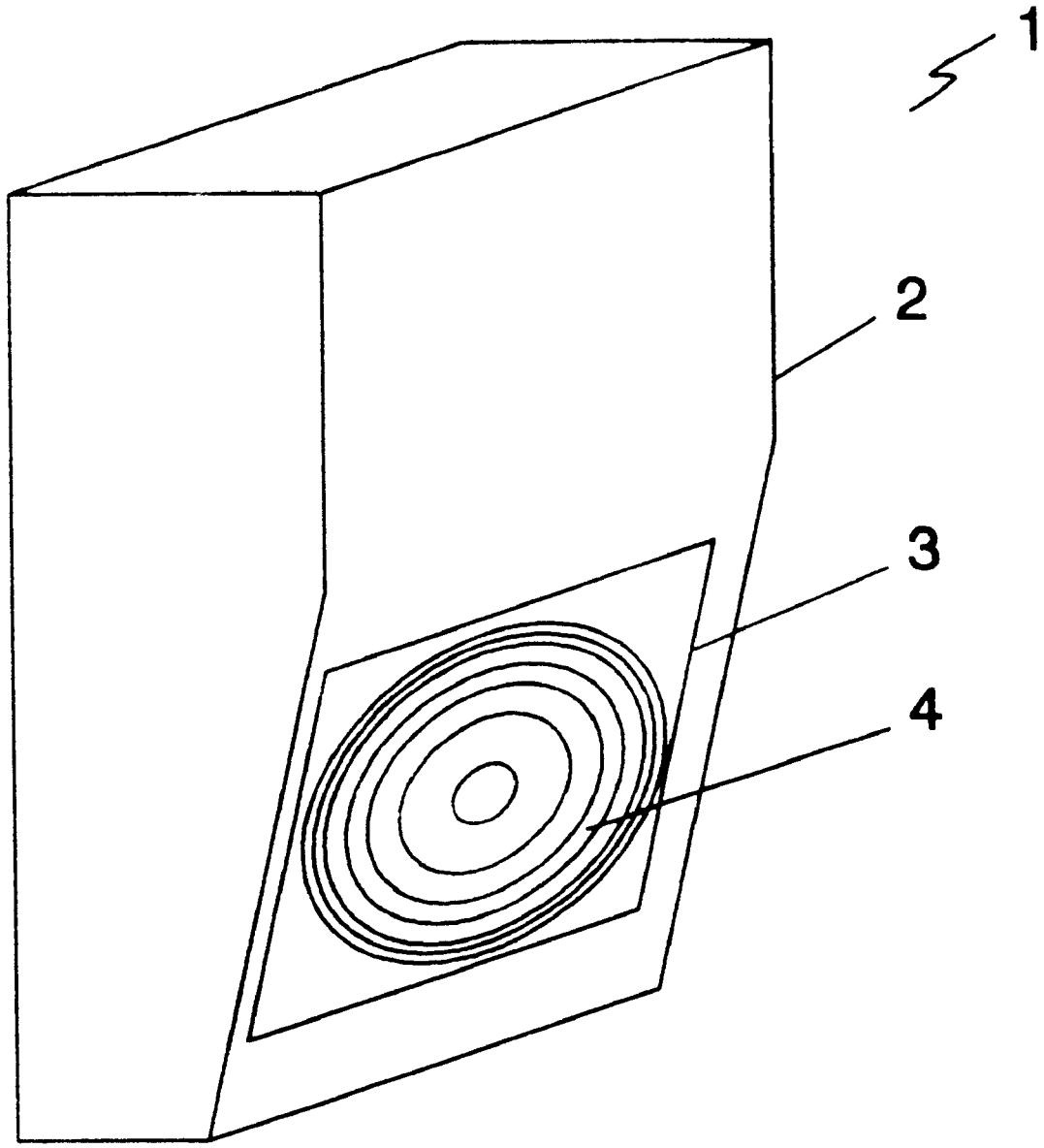
FIG. 1 is a perspective view of a passive infrared intrusion detector having an optical diffraction element integrated on its entrance window.

FIG. 1 shows a passive infrared intrusion detector 1 whose housing 2 has an entrance window 3 which faces a space to be monitored. The housing 2 is opaque to radiation, but infrared radiation in the wavelength range from 6 to 15 $\mu$m passes through the entrance window 3 into the interior of the housing. On its outer side, the entrance window 3 has an optical diffraction grating structure 4 which covers the entire area of the entrance window 3. The grating structure 4 consists of fine grooves which form a phase-modulating relief structure. It focuses a portion of the radiation from a source onto a sensor inside the housing 2. The distance between grooves is in the micrometer range, and only a few of the grooves of the grating structure are shown in the figure. The grating structure consists of the same material as the entrance window 3, e.g. polyethylene or polypropylene, and is deposited on its surface by injection molding in the manufacture of the entrance window.

As shown in FIG. 1, the optical diffraction element consists of an elliptical grating structure 4 in which the local grating constant, i.e. the distance between the individual grooves, decreases with increasing radius. This gives the optical diffraction grating structure a focusing capability. Instead of an elliptical grating structure, the grating structure 4 can be circular or rectilinear, with the grating constant again decreasing with increasing distance from the center of the grating structure. A rectilinear grating structure acts as a cylindrical focusing element.

The grating structure is chosen for focusing of the radiation from the source, and so as not adversely to affect detection of infrared radiation from the space being monitored. To this end, a radiation source is used whose wavelength differs from that of the infrared radiation, a source in the visible or near-infrared being suitable. The grating structure is designed for the wavelength of this source and does not interact significantly with the infrared radiation being monitored for intrusion. When this radiation source is designated as "light source" in the following, it is understood that its radiation need not be visible.

Figure 2A:
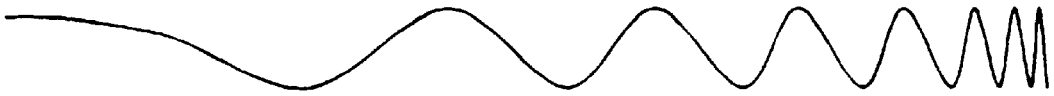
FIGS. 2*a,* 2*b,* 2*c* and 2*d* are exemplary profiles of optical diffraction grating structures for the entrance window.
Figure 2B:
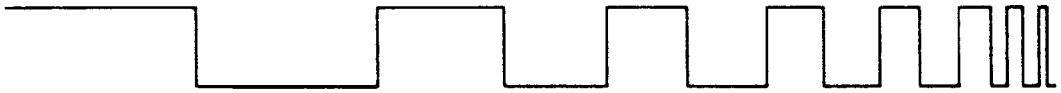
Figure 2C:
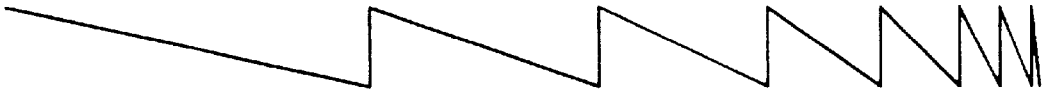
Figure 2D:
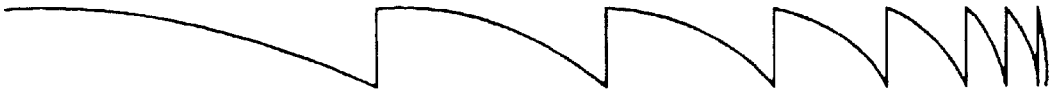

FIGS. 2*a,* 2*b,* 2*c* and 2*d* show profiles for the optical diffraction grating structure. Since this is a phase-modulating grating structure, the depth t of the grooves of the grating structure 4 is such that the optical phase difference due to the grating is $2\pi$ or a integral multiple of $2\pi$. In the case where the source and the sensor are behind the entrance window, and the grating structure is used for reflection, diffraction occurs in the material of the entrance window and the refractive index of the window material plays a role in determining the depth t. For a normal angle of incidence, the depth t is $\lambda/2n$, where $\lambda$ is the wavelength of the light and n the refractive index of the window material. For example, using a light-emitting diode as the radiation source at a wavelength of 800 nm, and with n=1.5, the depth t is 266 nm. With a larger angle of incidence, the depth is slightly less. Infrared radiation from the space being monitored is not affected by a grating of this depth, as its shortest wavelength is 6 $\mu$m and as, at this wavelength, the depth of 266 nm corresponds to a phase difference much less than $2\pi$. The profile of the grating structure 4 can be a sine function as shown in FIG. 2*a,* or a square-wave function as in FIG. 2*b,* or a triangular sawtooth function as in FIG. 2*c.* A grating having a profile with so-called "blaze" as in FIG. 2*c* is known as a blazed grating. Grating structures with these profiles are distinguished by different diffraction efficiencies and can be fabricated in different ways. FIG. 2*d* shows the profile of a grating with a non-linear blaze. It is similar to FIG. 2*c* but has a slight surface curvature.

The local grating constant should be considerably less than the shortest wavelength of the infrared radiation to be detected by the intrusion detector. A local grating constant that is small with respect to the wavelength of the infrared radiation assures that the grating structure does not interfere with infrared radiation to be monitored and does not impair its detection, but the light from the light source for monitoring the entrance window is focused onto the sensor. In choosing the local grating constant, its physical realizability and the resulting achievable diffraction efficiency should be taken into consideration. In this type of grating structure 4, the smallest local grating constant is 5 $\mu$m. This is greater than the recommended grating constant, but permits the structure to be produced with a shape accuracy which results in high diffraction efficiency.

Figure 3:
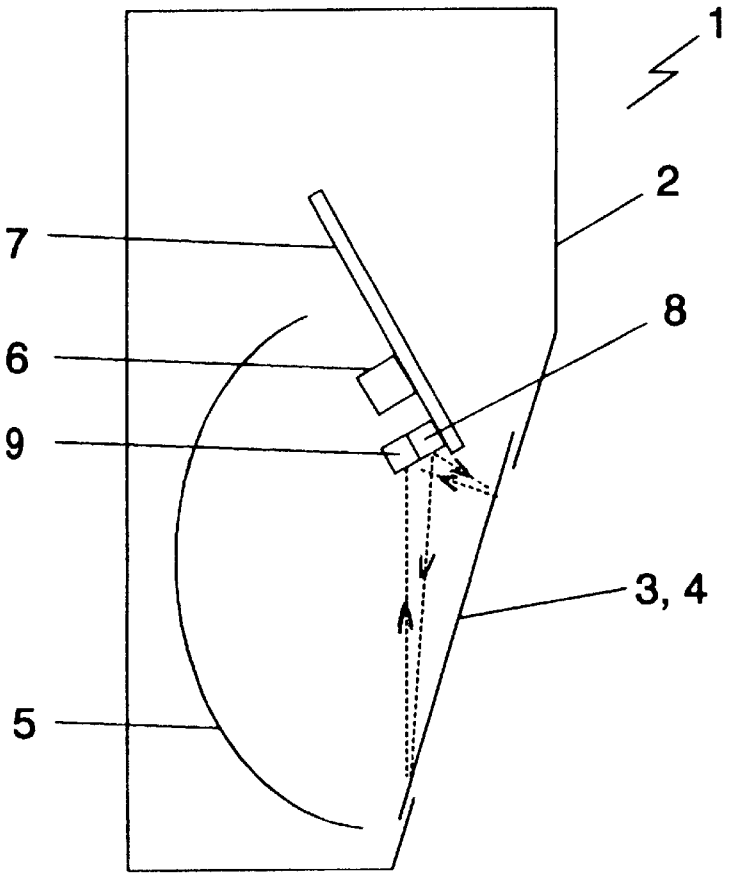
FIG. 3 is a vertical cross-section of a passive infrared intrusion detector, perpendicular to the entrance window, with a preferred first arrangement of the sabotage detector.

The vertical cross-section of the passive infrared intrusion detector 1 in FIG. 3 shows internal focusing optics 5 in the form of a concave mirror which focuses body radiation from the space being monitored onto the infrared sensors 6. These are sensitive to body radiation in the range of wavelengths from 6 to 15 $\mu$m. If radiation is detected in this range, a signal is passed to the evaluation-for-intrusion circuit on the printed circuit board 7. A light source 8 and the corresponding sensor 9 are on the printed circuit board 7 for monitoring the entrance window 3 for sabotage. Preferably, the source 8 is a light-emitting diode which emits radiation in the near-infrared wavelength range. So that the emitted radiation does not interfere with the detection of body radiation by the infrared sensors, it is pulsed, and the evaluation circuit is equipped with a suitable electrical filter. The sensor 9 associated with the source 8 is sensitive in the wavelength range of the source 8. Preferably, this is a photodetector, e.g. a silicon photodiode.

The beam path of the light emitted by the source 8 to monitor the entrance window 3 is shown by broken lines. The light falls on the entrance window 3 and is focused by the grating structure 4 onto the sensor 9. This involves first- or higher-order diffraction in the reflection mode. If the entrance window 3 and the grating structure 4 are covered by spray adhesive, for example, the grating structure becomes disfigured, and the light is no longer focused but scattered diffusely. As a result, the intensity of the radiation received by the sensor 9 decreases. A sabotage alarm signal is generated if the intensity is below a threshold.

In most cases, the diffraction efficiency of an optical diffraction grating structure is less than 100% even for a blazed grating, and only part of the radiation falling on the grating structure 4 is focused onto the sensor 9 as an entrance window monitoring signal. Another part of the radiation passes through the entrance window 3 into free space and does not contribute to the monitoring of the entrance window. A third part of the radiation is scattered at the entrance window 3. The scattered radiation is absorbed by the housing 2 or, after multiple reflections in the housing 2 and on the focusing optics 5, reaches the sensor 9. Radiation which reaches the sensor 9 due to scattering and multiple reflections forms a background signal for the entrance window monitoring signal, which does not vary in the event of sabotage by spraying. To reduce this background signal, the focusing optics 5 can be designed so that it absorbs radiation in the near-infrared region, but still reflects body radiation. For example, a black, light-absorbing material coated with a layer of indium tin oxide (ITO) is suitable for focusing optics of this type. The layer of indium tin oxide reflects radiation in the range of body radiation, but is transparent to visible and near-infrared radiation, so that the latter reaches the black material and is absorbed by it.

In an alternative arrangement, the source 8 is disposed on the printed circuit board 7 next to the sensor 9 and in a plane parallel to the entrance window. Mounting on the printed circuit board 7 is somewhat easier in this case.

Figure 4:
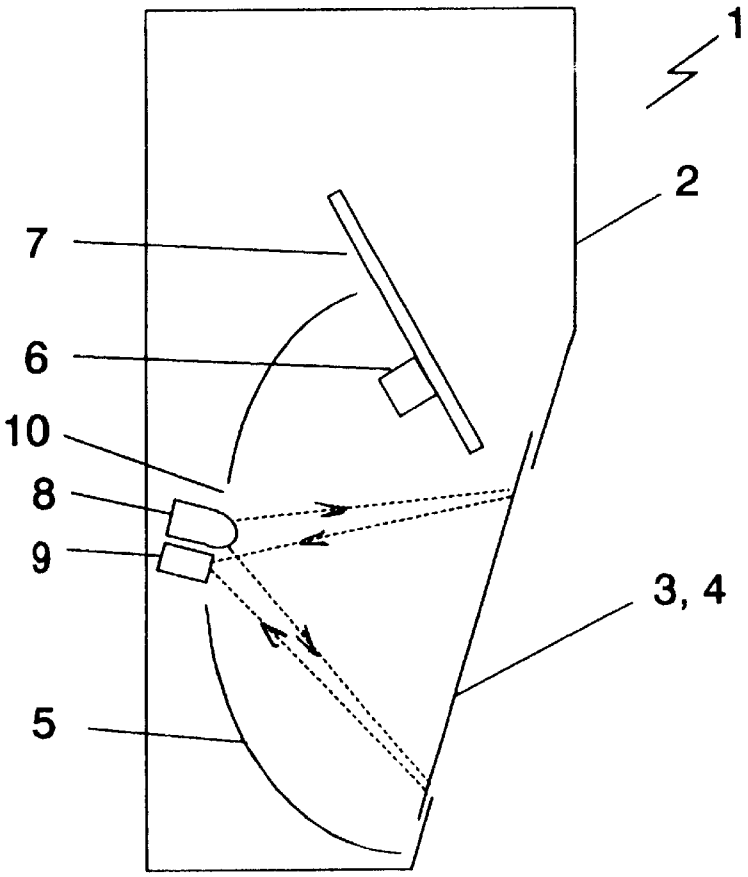
FIG. 4 is a vertical cross-section of a passive infrared intrusion detector, perpendicular to the entrance window, with a preferred second arrangement of the sabotage detector.

A further embodiment of the infrared intrusion detector is shown in FIG. 4. The source 8 and the associated sensor 9 are disposed behind the entrance window 3 side by side in an opening 10 in the focusing optics 5 opposite the entrance window 3. As compared with the arrangement in FIG. 3, this arrangement opposite the entrance window 3 with grating structure 4 permits a smaller angle of incidence of the radiation of the source 8 on the grating structure 4. With the smaller angle of incidence, diffraction efficiency is enhanced.

Since, in this arrangement, the source 8 and the sensor 9 are close together, an integrated element can be used which includes the source 8, the sensor 9, the drive circuit for the source 8, and the amplifier circuit for the sensor 9. Although the integrated element is not supported on the printed circuit board 7, its use has advantages in assembly.

Figure 5:
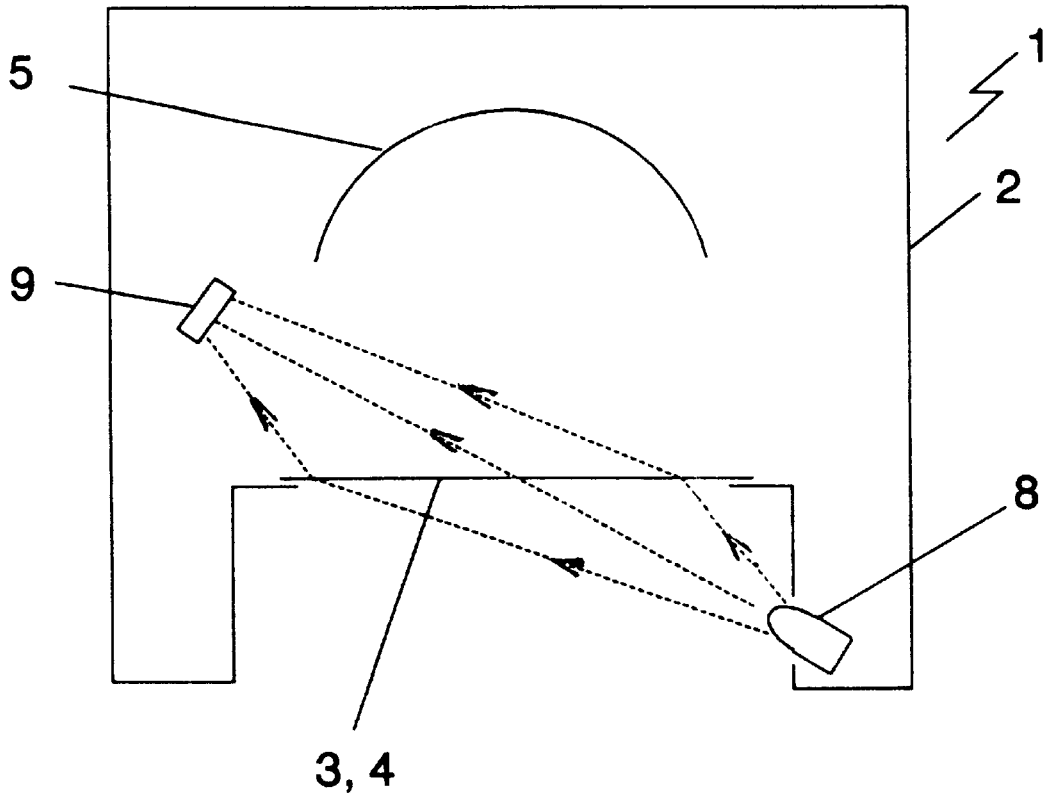
FIG. 5 is a horizontal cross-section of a passive infrared intrusion detector in which a light source is disposed outside the entrance window and a corresponding sensor within.

FIG. 5 shows a further embodiment of the invention in which the source 8 is arranged outside the entrance window 3 with grating structure 4, at the side of the housing 2 and with the sensor 9 inside the intrusion detector 1. Light from the source 8 falling onto the grating structure 4 of the entrance window 3 is focused onto the sensor 9 in first- or higher-order diffraction in the transmission mode. If the entrance window 3 is sprayed, the grating structure 4 is rendered ineffective and only a small proportion of the radiation of the source normally falling on the sensor 9 is received, and the monitoring signal is significantly reduced.

The grating structure can be made by the injection-compression process, in which the entrance window is first extruded and, with the material at a high temperature, the grating structure 4 is then embossed on the window. A master die containing the grating structure is used for the embossing. Such a master die consists of metal, for example. In a first step, the structure is produced in a photoresist, e.g., by a holographic method, a laser scribing process, or by electron beam lithography. Holography is employed especially for a sine profile. Laser scribing is suitable for square-wave or sawtooth grating profiles. When the desired structure is formed in the photoresist, a negative copy is made of it in metal, e.g. nickel, in a galvanic process. This metal copy is used as the master die for embossing the entrance window.

I/we claim:

1. A passive infrared intrusion detector comprising:

housing formed with a window transparent to infrared radiation;

an intrusion sensor disposed within said housing sensitive to said infrared radiation;

focusing optics disposed within said housing for focusing said radiation onto said intrusion sensor;

an evaluation circuit for detecting intrusion connected to said intrusion sensor; and a sabotage detector comprising:

a light source;

a sensor sensitive to said light emitted by said light source;

an optical diffraction grating disposed on the outside of said window for focusing said light emitted by said light source directly onto said light sensor; and an evaluation circuit for detecting sabotage connected to said light sensor.

2. The passive infrared intrusion detector according to claim 1, wherein said intrusion evaluating circuit and said sabotage evaluating circuit are integrated on a printed circuit board.

3. The passive infrared intrusion detector according to claim 1, wherein said light source and said light sensor are located on opposite sides of said window.

4. The passive infrared intrusion detector according to claim 3, wherein said light source is located within said housing behind said window.

5. The passive infrared intrusion detector according to claim 1, wherein said light source and said light sensor are located behind said window.

6. The passive infrared intrusion detector according to claim 5, wherein said light source and said light sensor are disposed on a printed circuit board containing said intrusion evaluating circuit and said sabotage evaluating circuit.

7. The passive infrared intrusion detector according to claim 5, wherein said light source and said light sensor are disposed substantially within an opening formed in said focusing optics.

8. The passive infrared intrusion detector according to claim 1, wherein said light source is selected for emission in the near-infrared wavelength range of 780 to 950 nm.

9. The passive infrared intrusion detector according to claim 1, wherein said light source is selected for emission in the visible wavelength range.

10. A method for detecting sabotage of a passive infrared intrusion detector substantially caused by covering a window through which infrared radiation is intended to pass with a substance opaque to infrared radiation, said method comprising the steps of:

sensing light emitted from a light source and focused directly onto a light sensor by an optical diffraction grating disposed on the outside of said window;

determining whether the sensed light intensity is outside a pre-selected range; and generating a sabotage alarm signal depending upon said sensed light intensity and said pre-selected range.

* * * * *